United States Patent [19]

Wilson et al.

[11] Patent Number: 4,854,575

[45] Date of Patent: Aug. 8, 1989

[54] FLUID FILLABLE, COLLAPSIBLE DUMBBELLS

[75] Inventors: Robert D. Wilson, Irvington-on-Hudson, N.Y.; Douglas W. Grigg, South Orange, N.J.; Donald G. Gialanella, New York, N.Y.

[73] Assignee: Wilson Water Weights, Inc., Irvington-On-Hudson, N.Y.

[21] Appl. No.: 144,280

[22] Filed: Jan. 14, 1988

[51] Int. Cl.[4] ..... A63B 11/00

[52] U.S. Cl. ..... 272/122

[58] Field of Search ..... 272/117, 122, 123, 130, 272/116; D21/197

[56] References Cited

U.S. PATENT DOCUMENTS

| | | | |
|---|---|---|---|
| 812,144 | 2/1906 | MacKenzie et al. | 272/122 X |
| 1,070,422 | 8/1913 | Creque | 272/122 X |
| 2,644,890 | 7/1953 | Hollihan | 272/122 X |
| 3,231,270 | 1/1966 | Winer | 272/123 |
| 3,781,007 | 12/1973 | Baker et al. | 272/123 |
| 4,029,312 | 6/1977 | Wright | 272/122 X |
| 4,103,887 | 8/1978 | Shoofler | 272/123 |
| 4,222,560 | 9/1980 | Hallerman | 272/130 X |
| 4,659,078 | 4/1987 | Blome | 272/130 X |
| 4,695,051 | 9/1987 | Jenson | 272/122 |

*Primary Examiner*—Richard J. Apley
*Assistant Examiner*—Robert W. Bahr
*Attorney, Agent, or Firm*—St. Onge Steward Johnston & Reens

[57] ABSTRACT

A dumbbell is provided which is collapsible for storage and/or convenient transportability and can be expanded, when required for purposes of exercising, by introduction therein of fluid such as water and sand. The dumbbell comprises a hollow, collapsible container comprising a closed loop of hollow tube having an elliptical or doughnut shape, a hollow handle traversing the gap between the inner walls of the closed loop and a fluid inlet provided with a plug seal. The outer peripheral wall of the closed loop is provided with accordion pleats biased into the closed portion but expandable against the bias under the influence of pressure generated by introduction of fluid into the container. The amount of fluid so introduced is a matter of choice of the user to achieve the desired overall weight of the device. Advantageously the dumbbells are integrally molded from thermoplastic resin.

10 Claims, 3 Drawing Sheets

FLUID FILLABLE, COLLAPSIBLE DUMBBELLS

BACKGROUND OF THE INVENTION

1. Field of the Invention

This invention relates to dumbbells and is more particularly concerned with dumbbells which are collapsible for storage and which can be expanded by introduction of fluid when required for use in exercising.

2. Description of the Prior Art

Dumbbells and barbells, which are collapsible for easy transportation and expandable, by introduction of fluids such as water and the like, when required for use, have been described previously.

Illustratively, Winer U.S. Pat. No. 3,231,270 describes a barbell which is collapsible for ease of transportation and which comprises two collapsible, spirally pleated fluid chambers each having a centrally disposed passage by means of which the fluid filled chambers can be securely mounted on either end of a metal bar. The latter can be comprised of several pieces which can be threadably connected to form a single bar of a desired length.

Bosko e al U.S. Pat. No. 3,334,899 describes a similar device which can be employed as a barbell or dumbbell depending upon the length of the bar employed. The device comprises two bulbs of rubber o plastic which can be filled with water or like fluid. The bulbs preferably have transparent walls so that decorative effects can be achieved by introducing flaked materials, miniature dolls and the like in suspension in the fluid employed for filling the bulbs. The bulbs are sealed with a plug and provided with female threaded sockets which engage male threads on the end of a hollow bar when the barbell or dumbbell is assembled.

Baker et al U.S. Pat. No. 3,781,007 also shows a device which can be employed as a dumbbell or barbell depending upon the length of the bar and the size of the attached collapsible fluid containers. In this instance the latter are suspended below opposite ends of the bar, using bearings which allow the bar to rotate when in use. The bar can be formed in sections which can be dismantled for ease of transportation.

Ionel U.S. Pat. No. 4,076,236 describes a dumbbell (hantel) comprising a handle on to each end of which can be mounted one or more hollow bodies each of which is fillable with fluid and is adapted to be attached threadably to the handle or a previously mounted hollow body. The weight of the barbell can thus be adjusted to a variety of levels thereby avoiding the need to have available and/or to transport a series of individual barbells of different weights. The device is readily disassembled for transportation and readily re-assembled when required for use.

The present invention is directed to a form of dumbbell which is collapsible when not in use but which does not require any assembling of components, other than introduction of fluid, prior to use and which is possessed of other advantages which will become apparent from the description which follows.

SUMMARY OF THE INVENTION

The invention in its broadest aspect comprises a dumbbell which is collapsible for storage and expandable upon introduction of fluid therein. The dumbbell comprises a collapsible hollow tubular container shaped roughly like a doughnut and having a hollow handle traversing its inner ring, each end of the handle being united to the wall of the container on the inner ring thereof. The interior of the handle communicates directly at each end thereof with the interior of the tubular container providing free access of fluid to the handle as the container is filled with fluid. The outer peripheral wall of the tubular container is formed with accordion pleats which are resiliently biased into the closed position in the collapsed mode of the dumbbell but are expandable in a controlled manner against this bias under the influence of pressure generated by introduction of fluid into the device. An inlet port is provided in the wall of the container for introduction and removal of fluid and the inlet port is provided with removable plug means for sealing the same.

In a preferred embodiment the dumbbell is integrally molded using a resilient thermoplastic resin having a flexural strength sufficient to impart the bias towards the closed position in the pleats on the outer peripheral wall of the container.

The resiliently biased accordion pleats in the peripheral wall of the container enable the container to undergo controlled expansion as fluid is introduced into the collapsed container. By this is meant that the container is constructed in such a way that fluid can be introduced into the container without also introducing significant amounts of air. This feature is particularly desirable as far as behavior of the dumbbell is concerned in subsequent use as a muscle exercising device. Thus, if significant expansion of the container occurs beyond that necessary to accommodate the fluid which is introduced, the fluid would be free to move around the inside of the container in uncontrolled fashion.

Further, the amount of fluid introduced into the device and hence the desired weight of the device, can be chosen from a range of amounts up to the maximum capacity of the container without enclosing any significant amount of air in the container. Thus the user of the dumbbell is offered a range of choices of overall weight of the dumbbell simply by appropriate choice of the amount of fluid introduced. An even wider range of choices of overall weight can be achieved by providing the user with a series of dumbbells of the invention having different capacities.

In addition, the device of the invention requires no assembly of a series of individual components prior to filling with fluid, nor any dismantling of components after use. All that is necessary in preparing the device for use is the introduction of the desired amount of fluid followed by application of the plug means. Similarly, after use, all that is required to restore the device to the collapsed condition is to remove the plug and empty out the fluid.

DETAILED DESCRIPTION OF THE INVENTION

Figure 1:
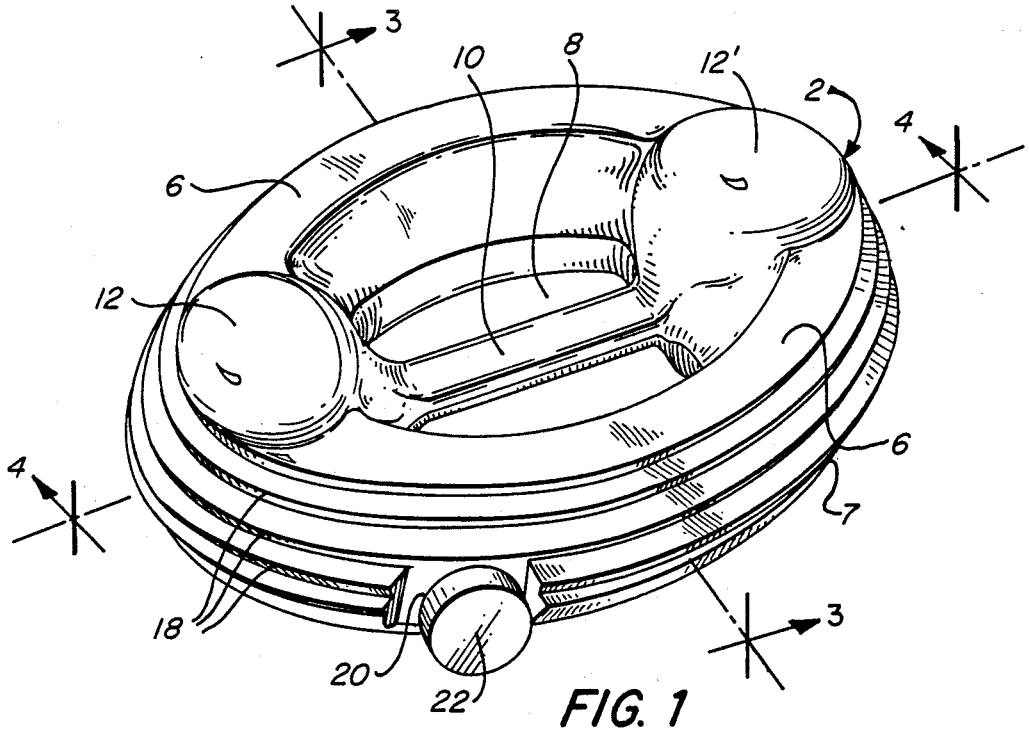
FIG. 1 is a perspective view of a dumbbell in accordance with the invention in an expanded condition.
Figure 2:
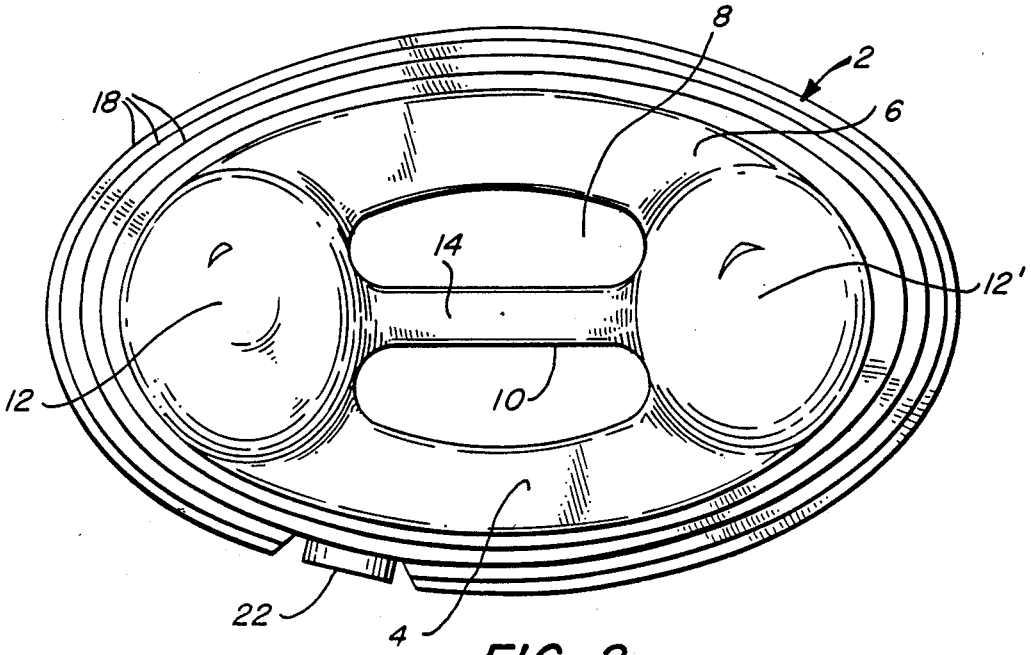
FIG. 2 is a plan view of the dumbbell shown in FIG. 1.
Figure 5:
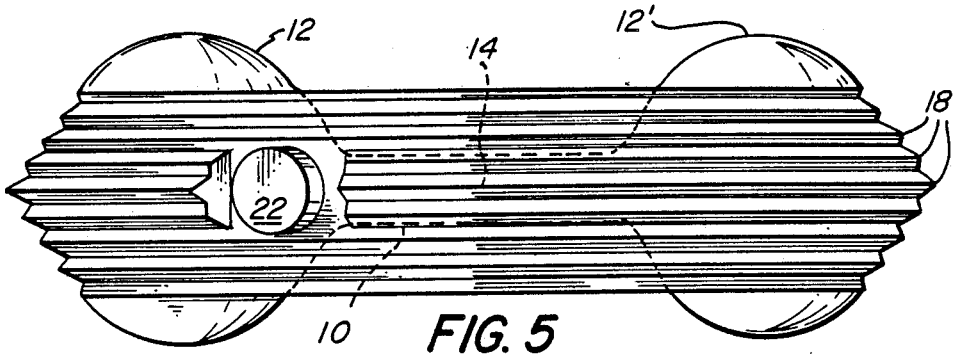
FIG. 5 is a side elevational view of the dumbbell shown in FIG. 1 taken from the right side of the latter in a direction perpendicular to the longitudinal axis of the handle.
Figure 4:
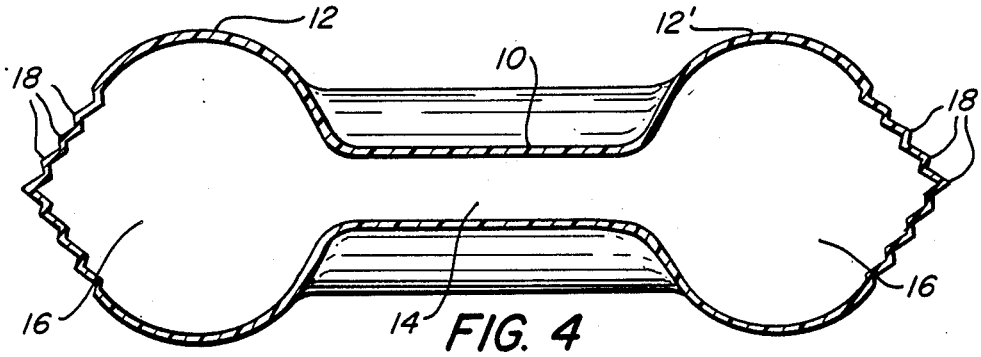
FIG. 4 is a cross-sectional view taken along the line 4—4 in FIG. 1.
Figure 6:
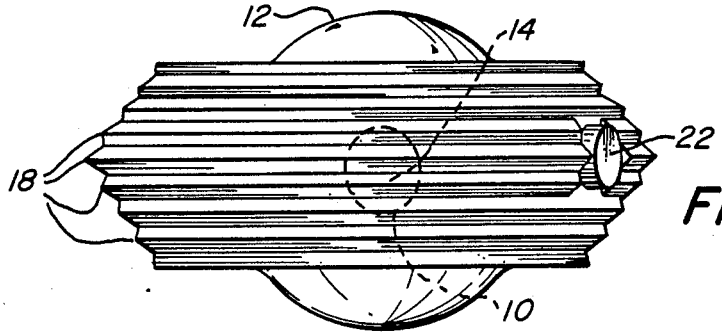
FIG. 6 is a side elevational view of the dumbbell shown in FIG. 1 taken from the left side of the latter in the direction of the longitudinal axis of the handle.
Figure 3:
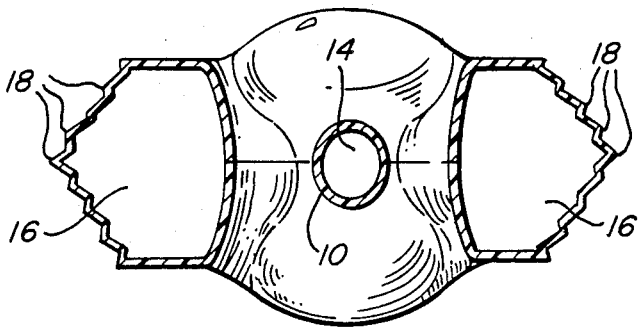
FIG. 3 is a cross-sectional view taken along the line 3—3 in FIG. 1.
Figure 8:
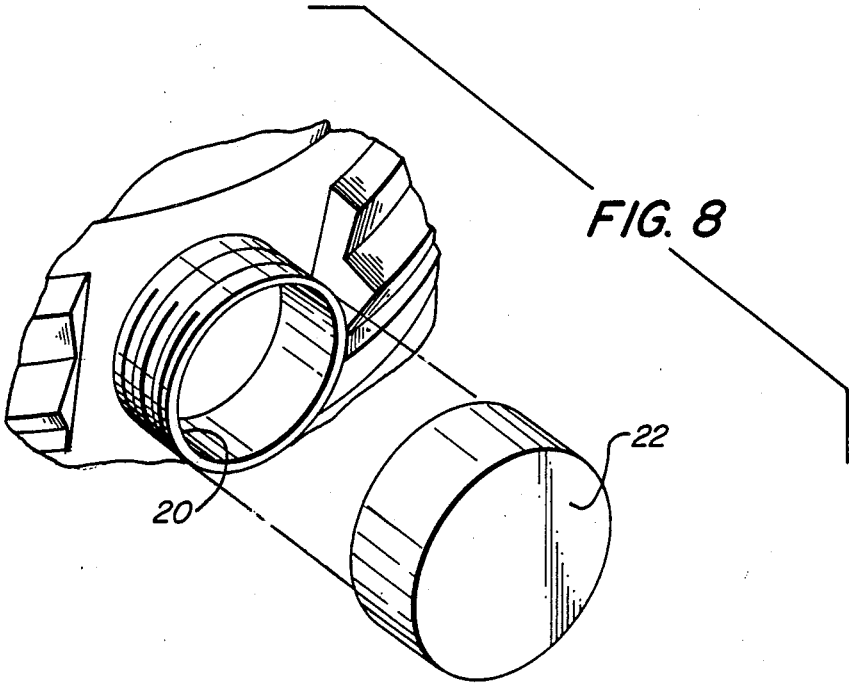
FIG. 8 is a partial view showing detail of construction of the plug and inlet port of the dumbbell shown in FIG. 1.

The invention will now be described by reference to the illustrative embodiment shown in the drawings. A device of the invention is shown overall as (2) in fluid-containing expanded condition in the perspective view in FIG. 1 and the top plan view in FIG. 2. The walls (6) of the device define an ellipsoidal or doughnut shaped hollow container (7) having an inner void (8) which is traversed by a hollow handle (10). The latter is joined at either end to two portions (12) and ($12^1$) of the device (2) which have a spheroidal cross-section as shown more clearly in FIG. 4 which is a cross-section taken along the line 4—4 in FIG. 1. The interior (14) of the handle (10) communicates directly with the interior (16) of the container (7) and fluid introduced into the container is free to flow through the said handle. Inlet port (20) and corresponding plug means in the form of a screw cap (22), shown in more detail in FIG. 8, permit introduction of fluid such as water, sand and the like and removal of the same as desired. The location of the inlet port (20) and cap (22) is not critical. Advantageously the inlet port is located on the outer periphery of the container (7) in the position illustrated in the various FIGS. 1, 2, 5 and 6 for convenience of introducing fluid, but other locations can be used if desired.

Figure 7:
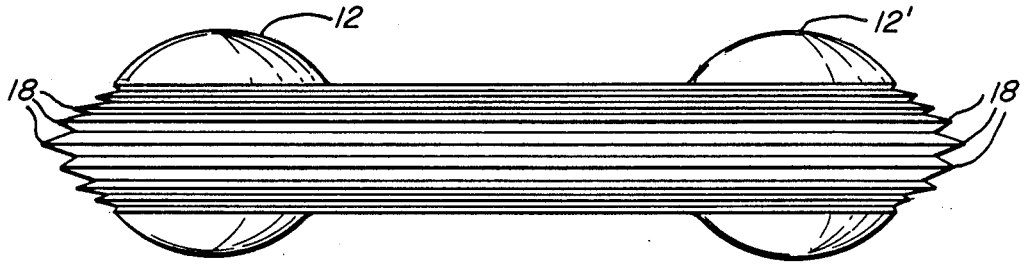
FIG. 7 is a side elevational view of the dumbbell shown in FIG. 1 in the collapsed state after removal of the plug and draining of the fluid contained in the dumbbell.

The outer peripheral wall of the container (7) is formed into a series of accordion pleats the folds of which circumscribe the peripheral wall. The pleats (18) are shown in the at least partially expanded state in the embodiment shown in FIG. 1, and in FIGS. 5 and 6 which show side elevational views of the device shown in FIG. 1 taken in the direction perpendicular to, and in the same direction as, the handle respectively. In the collapsed form of container (7), i.e., in the non-fluid filled form shown in FIG. 7, the pleats are biased into the closed, folded form. This biasing of the pleats into the closed, folded form in the collapsed state of the container is achieved advantageously by fabricating the pleats, and, indeed, the whole container by molding using conventional techniques from a thermoplastic material of appropriately chosen resilience and flexural strength. Illustrative of such materials are low density polyethylene, high density polyethylene, polypropylene, polyurethane, EVA and the like.

Where the container is molded from a relatively rigid thermoplastic material, the collapsed state of the container will approximate that shown in FIG. 7. When a relatively more flexible thermoplastic material is employed, the container may be collapsed to a greater degree and, depending upon the nature of the thermoplastic and the thickness of the container walls, it may be possible to compress further or fold the collapsed container for purposes of storage or transportation.

Advantageously, only the container is molded with the pleats (18) in the closed, folded configuration shown in FIG. 7. The resiliency of the material from which the pleats are formed ensures that the pleats (18) maintain this configuration unless or until fluid is introduced therein. When fluid is introduced the pleats (18) are caused to open or expand to the extent necessary to permit the container (7) to accommodate only the amount of fluid so introduced. Thus, this expansion of the container is controlled by the bias to the closed position inherently present in pleats (18) and in filling the container with a preselected amount of fluid, there is little or no tendency for significant amounts of air to be introduced into the interior of the container as would be possible if the expansion of the container took place in an uncontrolled manner. The presence of significant amounts of air in the container is to be avoided as far as possible in fluid filled dumbbells because it permits ready and uncontrolled movement of fluid in the dumbbell This in turn gives rise to sudden shifts of weight in the dumbbell when in use.

Further, the controlled expansion of the container (7) which i provided by the pleats (18) permits the user of the device to introduce any desired amount of fluid over a considerable range of possible amounts. For example, a dumbbell of the invention having a maximum capacity of about 8 fluid pints of liquid, can, by introduction of the appropriate amount of water, be employed in a weight range of about 6 to about 8 lbs. Similarly, dumbbells of lower or higher capacity than 8 fluid pints of liquid can be prepared in accordance with the invention to provide different ranges of useful operating weight after introduction of the appropriate amount of water. The use of fluids having a lower or higher density than water, such as liquid paraffin (lower density) and sand (much higher density) will extend considerably the useful weight range which can be achieved using any given dumbbell of the invention.

The number of pleats shown in the device (2) illustrated in the various FIGS. 1–8 is eight (8) but it is to be understood that this number is shown for purposes of illustration only and is not to be construed as limiting. A wide range of numbers of such pleats can be employed, depending upon the size of the particular device in question.

The device (2), except for the screw cap (22) can be integrally molded in a single unit, or in two preferably symmetrical mirror image halves which are subsequently joined together, using a thermoplastic resin such as those exemplified above and employing conventional molding techniques. The screw cap (22) can be separately fabricated from the same or a different material. In a preferred embodiment the wall forming the handle (10) has a greater thickness than the walls (6) and pleats (18). Illustratively the wall forming the handle (10) has an average thickness of the order of about 90 mils to about 110 mils, whereas that of the walls (6) and pleats (18) is of the order of about 15 mils to about 25 mils.

The device of the invention has been described by reference to various specific embodiments shown in FIGS. 1–8. It is to be understood, however, that these embodiments have been shown for purposes of illustration only and the scope of the invention is not to be construed as limited thereto. Various modifications which will be readily apparent to one skilled in the art can be made to the devices so illustrated without departing from the scope of the invention.

What is claimed is:

1. A dumbbell which is collapsible for storage and expandable upon introduction of fluid therein, said dumbbell comprising in combination:

a doughnut-shaped collapsible tubular container for receiving fluid;

a hollow handle traversing the inner ring of said doughnut-shaped container and attached at either end to the wall thereof;

the interior of said handle being in direct fluid receiving communication at either end thereof with the interior of said container;

the outer peripheral wall of said container being formed into accordion pleats resiliently biased into the folded position but expandable against said bias under the influence of pressure generated solely by introduction of fluid into said container to vary the volume of said container to accommodate said fluid and permit variation of the weight of said dumbbell without introducing significant amounts of air into said container;

an inlet port in the wall of said container; and removable plug means for sealing said inlet port.

2. A dumbbell in accordance with claim 1 wherein said container and said handle are integrally formed from resilient thermoplastic resin.

3. A dumbbell in accordance with claim 2 wherein said thermoplastic resin is low density polyethylene.

4. A dumbbell in accordance with claim 1 wherein the portions of said container located at each end of said handle have a spheroidal configuration.

5. A dumbbell which is collapsible for storage and expandable upon introduction of fluid for use in two collapsible hollow spheroidal members;

collapsible hollow handle means connecting said spheroidal members and providing communication between the interiors of said members;

two collapsible hollow arcuate conduits providing fluid tight communication between the interiors of said spheroidal members, the longitudinal axes of said conduits and said hollow handle means being substantially coplanar;

the outer peripheral walls of said conduits being formed in accordion pleats resiliently biased into the closed position but expandable against said bias under the influence of pressure generated solely by introduction of fluid into said container to vary the volume of said container to accommodate said fluid and permit variation of the weight of said dumbbell without introducing significant amounts of air into said container;

fluid inlet means located in the outer periphery of said dumbbell; and plug means for sealing said fluid inlet.

6. A dumbbell in accordance with claim 5 which is integrally formed from resilient thermoplastic resin.

7. A dumbbell in accordance with claim 6 wherein said thermoplastic resin is low density polyethylene.

8. A dumbbell which is collapsible for storage and expandable upon introduction of fluid therein, said dumbbell comprising in combination:

a hollow collapsible container comprising a closed loop of hollow tube having a substantially elliptical shape, each of the foci of said ellipse having enlarged cross-sections and being connected to each other by a hollow tubular handle;

the peripheral wall of said closed loop being formed into accordion pleats resiliently biased into the closed position but expandable against said bias under the influence of pressure generated solely by introduction of fluid into said container to vary the volume of said container to accommodate said fluid and permit variation of the weight of said dumbbell without introducing significant amounts of air into said container;

an inlet port in the wall of said container;

plug means for sealing said inlet port.

9. A dumbbell in accordance with claim 8 wherein said container and said handle are integrally formed from resilient thermoplastic resin.

10. A dumbbell in accordance with claim 9 wherein said thermoplastic resin is low density polyethylene.

* * * * *